US010079460B2

(12) United States Patent
Dressel et al.

(10) Patent No.: US 10,079,460 B2
(45) Date of Patent: Sep. 18, 2018

(54) BUSBAR, CONSUMER UNIT, USE OF SUCH A CONSUMER UNIT, POWER TRANSMISSION DEVICE AND BUILDING ELEMENT

(71) Applicant: Apure Holding LLC, Miami, FL (US)

(72) Inventors: Konrad Dressel, Leipzig (DE); Nils-Ove Mellies, Berlin (DE); Timo Höfges, Rotenburg-Lispenhausen (DE); Andreas Thomas, Wanfried (DE); Markus Vockenroth, Bebra-Weiterode (DE)

( * ) Notice: Subject to any disclaimer, the term of this patent is extended or adjusted under 35 U.S.C. 154(b) by 0 days.

(21) Appl. No.: 15/389,235

(22) Filed: Dec. 22, 2016

(65) Prior Publication Data

US 2017/0179656 A1 Jun. 22, 2017

(30) Foreign Application Priority Data

Dec. 22, 2015 (DE) ..... 10 2015 122 653

(51) Int. Cl.
*H01R 25/14* (2006.01)

(52) U.S. Cl.
CPC ..... *H01R 25/145* (2013.01); *H01R 25/142* (2013.01)

(58) Field of Classification Search
CPC .... H01R 25/14; H01R 25/142; H01R 25/145; H01R 25/147; H01R 25/162
USPC ..... 439/110–122, 491
See application file for complete search history.

(56) References Cited

U.S. PATENT DOCUMENTS 3,771,103 A * 11/1973 Attema ..... E04B 9/064 439/110
4,881,907 A * 11/1989 Bergman ..... H01R 25/14 174/117 F
4,968,262 A * 11/1990 Widell ..... H01R 25/142 439/121
6,718,674 B2 * 4/2004 Caveney ..... G09F 3/20 40/611.09
7,410,386 B2 * 8/2008 Fabian ..... H01R 13/4367 439/441

(Continued)

FOREIGN PATENT DOCUMENTS

DE 101 21 584 A1 6/2002
GB 21 40 983 A 12/1984
WO 00/60706 A1 12/2000

OTHER PUBLICATIONS

German Patent Office, Office Action for German patent application No. 10 2015 122 653.7, dated Sep. 30, 2016.

*Primary Examiner* — Gary Paumen
(74) *Attorney, Agent, or Firm* — SoCal IP Law Group LLP; Nikki M. Dossman; Steven C. Sereboff

(57) ABSTRACT

The invention relates to a busbar having a profiled body which forms an elongate receiving channel, a first and a second groove being formed in the channel floor, and the electrical conductors being arranged in the first and second groove. Furthermore, the invention relates to a consumer unit for securing to such a busbar and for drawing current or data from such a busbar, and the use of the consumer unit in conjunction with such a busbar. Further aspects of the invention form a power transmission device having such a busbar and such a consumer unit, as well as a building element in which such a busbar is installed.

34 Claims, 3 Drawing Sheets

(56) References Cited

U.S. PATENT DOCUMENTS

| | | | | |
|---|---|---|---|---|
| 7,455,535 | B2 * | 11/2008 | Insalaco | H01R 25/14 439/110 |
| 7,559,791 | B1 * | 7/2009 | Kao | H01R 13/465 439/491 |
| 7,762,821 | B2 * | 7/2010 | Patterson | H01R 25/147 362/147 |
| 8,419,450 | B2 * | 4/2013 | Schmiedle | H01R 25/14 439/110 |
| 2003/0224636 | A1 * | 12/2003 | Lorenzen | H01R 27/02 439/110 |
| 2004/0038567 | A1 | 2/2004 | Thurgood | |
| 2006/0116011 | A1 * | 6/2006 | Sinclair | H01R 25/14 439/110 |
| 2006/0199424 | A1 * | 9/2006 | Landis | H01R 13/465 439/491 |
| 2007/0259544 | A1 * | 11/2007 | Peiker | B60R 11/0241 439/120 |
| 2014/0179133 | A1 * | 6/2014 | Redel | F24J 2/5207 439/121 |
| 2015/0236462 | A1 * | 8/2015 | Davidson, Jr. | H01R 25/142 439/122 |
| 2016/0020053 | A1 * | 1/2016 | Dozier | H02P 1/26 200/50.21 |

* cited by examiner

BUSBAR, CONSUMER UNIT, USE OF SUCH A CONSUMER UNIT, POWER TRANSMISSION DEVICE AND BUILDING ELEMENT

NOTICE OF COPYRIGHTS AND TRADE DRESS

A portion of the disclosure of this patent document contains material which is subject to copyright protection. This patent document may show and/or describe matter which is or may become trade dress of the owner. The copyright and trade dress owner has no objection to the facsimile reproduction by anyone of the patent disclosure as it appears in the Patent and Trademark Office patent files or records, but otherwise reserves all copyright and trade dress rights whatsoever.

RELATED APPLICATION INFORMATION

This patent claims priority from German Patent Application No. DE 10 2015 122 653.7 filed Dec. 22, 2015, which is incorporated herein by reference.

BACKGROUND

Field

The invention relates to a busbar for the position-free arrangement of consumer units along the rail. Busbars may be, for example, lights or other electrical devices. Such a busbar has at least two electrical conductors.

Description of the Related Art

Such power distributor devices with a busbar and consumer unit have become known in various embodiments. Such a busbar with a consumer unit is known, for example, from DE 2 132 133 A1. It is described here how a consumer unit can be slid on a busbar and secured thereto, wherein the busbar has at least two electrical conductors and at least one protective conductor.

The consumer unit has a protective conductor which projects at the end side, can close a contact with a rail protective conductor before adapter attachment and is arranged on the channel floor of the busbar. Locking parts which can be moved mechanically in the opposite direction to rail sidewalls and can be connected in a positively and/or frictionally locking fashion to attachment receptacles of the busbar are arranged laterally on the consumer unit. Furthermore, electrical conductors which can close contacts with the electrical conductors of the power distributor rail as a function of the locking parts, but with a delay in terms of movement with respect thereto, are provided.

The lack of known devices is a result of the awkward handling and inadequate electrical safety. Furthermore, the known adapters have, as a result of the low current take-up capability, a limited field of use, for example because all the consumer units have to operate with the same mains voltage. Furthermore, independent operation of a plurality of consumer units is often not possible.

A further disadvantage is the poor aesthetics of the known busbars which are usually surface-mounted and in which the electrical conductors and their securing means are visible, which makes them visually unattractive, which increases as dust increasingly accumulates on them.

SUMMARY

The object of the invention is therefore to make available an improved busbar, an improved consumer unit and an improved combination thereof, which is, in particular, safe to handle and can be flexibly combined with consumer units with different functions, as well as to ensure aesthetic integration into building elements. Furthermore, the intention is to provide a durable, easy-to-mount and cost-effective design which is economical in terms of energy.

The invention relates to a busbar having a profiled body which forms an elongate receiving channel having a channel floor. The receiving channel is bounded laterally by a first and a second sidewall of the profiled body, which sidewalls are arranged opposite one another. The first and second sidewalls bound, on a front side of the profiled body, an elongate receiving opening of the receiving channel in the transverse direction. The channel floor of the profiled body connects the first and second sidewalls to one another. Furthermore, at least two electrical conductors are mounted on the profiled body in such a way that they run in the longitudinal direction of the profiled body and are insulated from one another. A first and a second groove are formed in the channel floor, the electrical conductors being arranged in the first and second groove. Preferably, none of the electrical conductors is arranged outside the first and second groove.

It is advantageous with such an embodiment that the electrical conductors are within grooves and only accessible with difficulty from the outside. This is particularly safe in application. In addition, the electrical conductors lie deep in the interior of the profiled body and are virtually invisible from the outside, providing good esthetics. Such a profiled body is additionally suitable for largely concealing a consumer unit in the receiving channel, which is also visually attractive. The provision of two grooves makes it possible to avoid electrical interference between different electrical conductors, and correspondingly also to provide a relatively high number of different electrical conductors.

In one specific embodiment, the electrical conductors are arranged covered when viewed from the direction of the receiving opening. They are therefore concealed when viewed from the outside and an attractive design is provided. For this purpose, the electrical conductors should not have a point of intersection with a viewing axis which intersects the receiving opening orthogonally. This is sufficient, in particular, in applications in which the busbar is arranged spaced apart from the viewer, for example on the ceiling. There can optionally be provision that the electrical conductors do not have a point of intersection with a viewing axis which intersects the receiving opening, in particular at any angle. The first and second grooves are preferably partially covered with an inwardly protruding collar. These form an undercut behind which the electrical conductors can be concealed. When there are collars on both sides, electrical conductors can be concealed on both sides of the groove which is partially covered in this way. The collar is preferably embodied in one piece with the channel floor. This is cost-effective.

According to one specific embodiment, the receiving opening which is bounded by the first and second sidewalls is of planar design. It is therefore suitable for flush arrangement in planar surface elements or structural elements such as ceilings, walls or floors, not only of buildings but also, for example, of pieces of furniture.

In order to juxtapose a plurality of profiled body sections it is appropriate to make the receiving opening open in the longitudinal direction. Furthermore, the first and second grooves should be aligned in such a way that they run in parallel.

In order to avoid electrical interference between different electrical conductors and in order to lay the electrical conductors as far as possible in the shade, in one variant of the busbar there is provision that the first groove adjoins the first sidewall, and the second groove adjoins the second sidewall. Furthermore, a design in which the distance between the first and the second groove is larger than the groove widths of the first and the second groove is esthetically preferable. In the region which can be seen most easily, a visible surface which gives a harmonious visual effect is therefore made available.

For a high-quality appearance, in one specific embodiment there is provision that the channel floor forms a pedestal between the first and second grooves.

A design according to which the depth of the first and second grooves is at maximum 25% of the total depth of the receiving channel proves particularly advantageous. The first and second grooves are located correspondingly at a depth within the profiled body and between the sidewalls there is space for at least partially countersunk accommodation of a consumer unit.

Furthermore, there is the option of the profiled body having a profile or a plurality of assembled profiled parts, preferably one or more extruded parts or continuous-cast parts, the first and second sidewalls being associated with different profiled parts. In this way, at least one of the sidewalls can be removed, making it possible to easily mount the electrical conductors in the grooves located on the channel floor. For the same reason, an embodiment is particularly preferred in which the profiled bodies are composed of three profiled parts. It is appropriate here to apportion the profiled body in such a way that the channel floor is associated with another profiled part than the first and the second sidewall. In this way, it is possible to connect the sidewalls to the channel floor, for example, after the mounting of the electrical conductors in the grooves. Simple mounting is obtained with one embodiment according to which the profiled parts are plugged together at joints. Low fabrication costs and simplified handling are achieved if the profiled parts of the first and second sidewalls are embodied as identical parts. The profiled body is preferably comprised of a metal, particularly preferably of aluminum. However, versions made of steel or of plastic which are optionally painted or provided with a metallic layer are also possible. The profiled body is preferably composed of a uniform material, even when there are multiple components.

In one more detailed embodiment of the busbar there is provision, for the sake of a visually attractive design and simple mounting, that the profiled body has, with the exception of an off-center alignment rail, a mirror-symmetrical cross section. Such an alignment rail forcibly brings about correct insertion of a consumer unit into the busbar. The alignment rail can be, for example, a groove or a spring.

In order to avoid a visually unattractive effect, in one specific position there is provision that the alignment rail is embodied in the region of the groove floor of the first or the second groove. The alignment rail is located inconspicuously in the shade here.

Basically, the busbar can be equipped with electrical conductors which are power conductors and/or data conductors. For position-independent formation of contacts, the power conductors are to be constructed with a contact face which is exposed along the longitudinal direction of the busbar. In particular, at least one of the electrical conductors can optionally conduct a low voltage of at maximum 50 V, preferably 12 V or 24 V, AC voltage. In another option, at least one of the electrical conductors can conduct a low voltage between 50 V and 1000 V, preferably 120 V±15 V or 230 V±23 V, AC voltage. As a further option, at least one of the electrical conductors can be a grounding conductor and/or at least one of the electrical conductors can be a data conductor.

The embodiment of the busbar with two grooves expands its advantages, in particular in a variant in which exclusively electrical conductors with a maximum low voltage of 50 V AC voltage are arranged in the first groove. With the voltages there is little risk of electrical interference occurring.

According to another or additional embodiment there is provision that all the electrical conductors with a low voltage of over 50 V AC voltage are arranged in the second groove. In this way, all the power conductors with high current are therefore bundled in the second groove. In combination with the arrangement of the electrical conductors with a maximum low voltage of 50 V AC in the first groove, this therefore permits separation of the conductors with a relatively low current from the conductors with a relatively high current. Any electrical conductors which conduct data are preferably integrated in the first groove and are considered here to be low-voltage conductors with at maximum 50 V AC voltage.

The first and second groove as such each have two groove sidewalls which are connected to one another via a groove floor in each case. In one preferred embodiment of the busbar, the electrical conductors, preferably all, are mounted here on the groove sidewalls. Here, the electrical conductors can be concealed outside the viewing axis. At least one electrical conductor, but preferably at least two electrical conductors, is/are preferably arranged on each of the groove sidewalls. Two electrical conductors on a common groove sidewall are then preferably arranged running adjacent one on top of the other in a perpendicular direction with respect to the groove floor. In most applications it is sufficient to arrange at maximum six electrical conductors on one groove sidewall. A particularly interesting variant for the current market comprises ten electrical conductors. At maximum three electrical conductors thereof are preferably arranged per groove sidewall.

In order to mount the electrical conductors, in one specific embodiment T grooves for receiving the electrical conductors are respectively formed on the groove sidewalls. If the profiled body is composed of a non-electrically conductive material, the electrical conductors can be clamped or inserted directly into the T grooves. If the profiled body is composed of an electrically conductive material, the electrical conductors can have individual or common insulation bodies which are clamped or inserted into the T grooves. The term T groove is also to be understood as meaning couplings which are similar to a dovetail. The coupling between the electrical conductor and the profiled body can also optionally be formed with the sides inverted.

Furthermore, in one specific variant of the busbar there is provision that at least one T groove is respectively formed on the outside of the first sidewall and/or of the second sidewall and/or of the channel floor by the profiled body. By using these T grooves, simple mounting is possible, for example on a substructure of a suspended ceiling. In the T groove it is possible to insert, for example, threaded nuts or screw heads. Clamps and hoops can also be suspended or inserted. When the profiled body is molded with a material which hardens, e.g. concrete, a stable, positively locking connection is produced.

Optical evaluation of the busbar is achievable by addition such that a colored decorative rail is attached to the profiled body in an exchangeable fashion in the region of the channel floor, which decorative rail can be viewed from the direction of the receiving opening. As a result, it is possible for the user to adapt this rail to the color of the installation surroundings, e.g. also by painting the decorative rail. The decorative rail preferably leaves the grooves exposed and extends over the entire length of the busbar.

An inconspicuous design with few points which are susceptible to soiling is obtained if the inner sides of the first and second sidewalls which can be viewed from the direction of the receiving opening are of planar design. An essentially rectangular receiving space is preferably formed between the first and second sidewalls, the channel floor and the receiving opening. Only the grooves then interrupt the channel floor with planar groove openings. The inner sides of the first and second sidewalls should be aligned in parallel with one another. As a result, the receiving opening is narrow. Furthermore, the channel floor should be aligned perpendicularly with the respect to the first and second sidewalls in the region between the first and second grooves.

In one specific embodiment of the busbar, the first and second sidewalls bound the receiving opening with an outwardly projecting collar. As a result, a stable linear boundary of the receiving opening is achieved. Furthermore, a precise connection to the periphery is possible by virtue of the fact that the collar bears, for example, on the ceiling surface. The width of the frame is preferably at maximum three times the wall thickness of the sidewalls. The viewer then sees just a narrow collar which does not have any further visually disruptive effect. The wall thicknesses of the profiled body are preferably at maximum 3 mm.

Furthermore, there can optionally be provision that the busbar has at least one covering strip for the first and/or second groove which can be plugged, preferably clamped or latched, into the first and/or the second groove. In this way, the groove can be covered on the other side of a consumer unit. In addition to visual advantages, this can also increase electrical safety.

The invention also relates to a consumer unit for securing to a busbar and for drawing current or data from the busbar, as described above and in the text which follows. The inventive embodiment of the busbar permits safe power extraction which is possible independently of the position along the bar. As a result of the position of the electrical conductors the appearance is high quality and inconspicuous. The consumer unit should have a functional element. In particular functional elements from the group comprising lighting means, projector, ceiling light, light strip, spotlight, camera, loudspeaker, screen, socket, data interface, daylight sensor, image sensor, movement sensor, movement detector, smoke sensor, smoke detector, fan, air-conditioning device, HVAC diffuser or a combination thereof are suitable.

It can be sufficient to equip the consumer unit with a single runner. With the latter it is possible for the consumer unit to engage in one of the first or second groove of the profiled body. The other groove then remains free. In one preferred embodiment, the consumer unit has, however, two free-standing parallel runners. With these it can then engage in both of the first and second grooves. As a result the consumer unit is mounted in a stable fashion.

In order to couple the consumer unit to a busbar there is optionally provision that in each case at least one laterally extendible coupling element is arranged in at least the one runner, one of the two runners, and preferably one in each of the runners. By extending the coupling elements, the consumer unit can then be coupled to the busbar. In this case, at least one of the laterally extendible coupling elements should be an electrical contact element. This can be placed in contact with one of the electrical conductors of the busbar by the extension process. Furthermore, at least one of the electrical contact elements, preferably each of the electrical contact elements, preferably forms a mechanical locking element. The consumer unit can then be locked to the busbar by extending the contact elements. Because in many applications the specific consumer unit does not have to be connected to all the electrical conductors of the busbar, it is appropriate for achieving a stable mount if at least one of the laterally extendible coupling elements is a non-electrically conductive or connected mechanical locking element. For reasons of cost, the pure locking elements are preferably embodied from another material than the electrical contact elements. Simplification of the mounting is achieved with respect to the above if all the coupling elements are composed of electrically conductive material. Depending on the functional element, different coupling elements in the consumer unit can then be connected electrically.

A variant of the consumer unit in which the coupling elements are extended by pivoting is space-saving and slim. In the folded-in position, the coupling elements then preferably extend along the runner, in particular in the longitudinal direction. The pivoting preferably occurs about an orthogonal with respect to the receiving opening of the busbar. As a result, the coupling elements can engage in longitudinal grooves in the region of the electrical conductors and at the same time form a stable mechanical coupling.

In one specific embodiment of the consumer unit, on the side of the consumer unit (50) lying opposite the runners, a tool receptacle is formed which is connected to the laterally extendible coupling elements via a mechanical gear mechanism, it being possible to bring about extension or retraction of the coupling elements by means of an activation operation on the tool receptacle. The tool receptacle is preferably embodied as a plug-in opening, for example for a screwdriver, an Allen key or the like. Such a plug-in opening is small and inconspicuous.

The mechanical gear mechanism can optionally have a gear drive or a belt drive. In this way, a plurality of coupling elements can be driven by a common tool receptacle.

The invention also relates to an optional attachment tool with manual actuation means, or to an attachment motor with a driven tool, which attachment tool and attachment motor can be respectively attached to the consumer unit. This simplifies the mounting, in particular overhead on the ceiling. Such an attachment tool or such an attachment motor should fasten the consumer unit for the sake of simple handling until it is secured to the busbar.

In addition, an optional addition to the consumer unit is provided in which the consumer unit has an alignment means. This can be a pin, a cam, a fin or a groove. The alignment means should correspond to the alignment rail of the busbar. Only if the alignment means is in engagement with the alignment rail is the mounting position of the consumer unit in the busbar achieved and the coupling elements can be extended. This effectively prevents the busbar being inserted rotated through 180 degrees into the busbar. For covered or at least inconspicuous arrangement the orientation means should be arranged on the first or the second runner.

The invention also relates to a use of a consumer unit as described above or in the further text by securing to a busbar and drawing current or data from the busbar, as described above and below. The use of such a consumer unit permits contact to be made with the electrical conductors which lie concealed in the grooves and allows consumer units with different functions to be mounted on the same busbar.

Contact is made with selected electrical conductors of the busbar depending on the requirements for current and data.

Furthermore, the invention relates to a power transmission device having a busbar as described above and in the further text, and a consumer unit which can be or is secured to the busbar, as is described above and below. The combination of the busbar and of the consumer unit provides the respective advantages as described with respect to the individual embodiment variants of the individual parts. In particular a visually attractive arrangement and highly flexible and optionally individual operation of different consumer units are made possible.

It is particularly visually attractive if the consumer unit is at least 75 vol %, preferably at least 80 vol %, and more preferably at least 85 vol % and particularly preferably at least 90 vol % arranged within the receiving channel. Correspondingly, the consumer units hardly protrude from the busbar. A planar covering surface can be made available without objects protruding therefrom.

In one specific embodiment, the consumer unit has sidewalls which lie opposite with respect to one another and with which the consumer unit is arranged spaced apart in the transverse direction with respect to the inner sides of the first and second sidewalls of the profiled body. As a result of this free space, the consumer unit can easily be plugged into the busbar and slid along the longitudinal axis. In the process, in particular the inner side of the busbar is not scratched and consequently remains visually attractive. The centering of the busbar in the profiled body is preferably carried out by engaging one runner or both runners in the first and/or second groove.

Particular advantages are provided by an embodiment of the power transmission device according to which the consumer unit is actuated via one of the electrical conductors. In this way, the consumer unit can therefore be actuated externally, for example a home control system. A plurality of consumer units on the same busbar can be controlled independently.

One specific embodiment provides that a chip for receiving and implementing control signals and/or outputting operating states is arranged in the consumer unit. In this way, the number of necessary electrical conductors for independent operation of a plurality of consumer units on the busbar is minimized.

The reception and the implementation of control signals and/or the outputting of operating states optionally take place via one of the electrical conductors. This is possible via an additionally provided data conductor or else modulation onto a current-conducting conductor. However, the reception and the implementation of control signals and/or the outputting of operating states can optionally take place in a wireless fashion. A plurality of consumer units can also use different control paths.

Furthermore, the invention relates to a building element having a planar structural element from the group comprising the wall, ceiling and floor, wherein a busbar as described above and below is integrated with the receiving opening flush into the planar structural element. Therefore, actually only the front edge of the sidewalls are visible. In the intermediate space, an inconspicuous shaded area is produced in which the electrical components can be concealed.

DESCRIPTION OF THE DRAWINGS

Further features, details and advantages of the invention can be found in the wording of the claims and in the following description of exemplary embodiments with reference to the drawings, in which:

DETAILED DESCRIPTION

Figure 1:
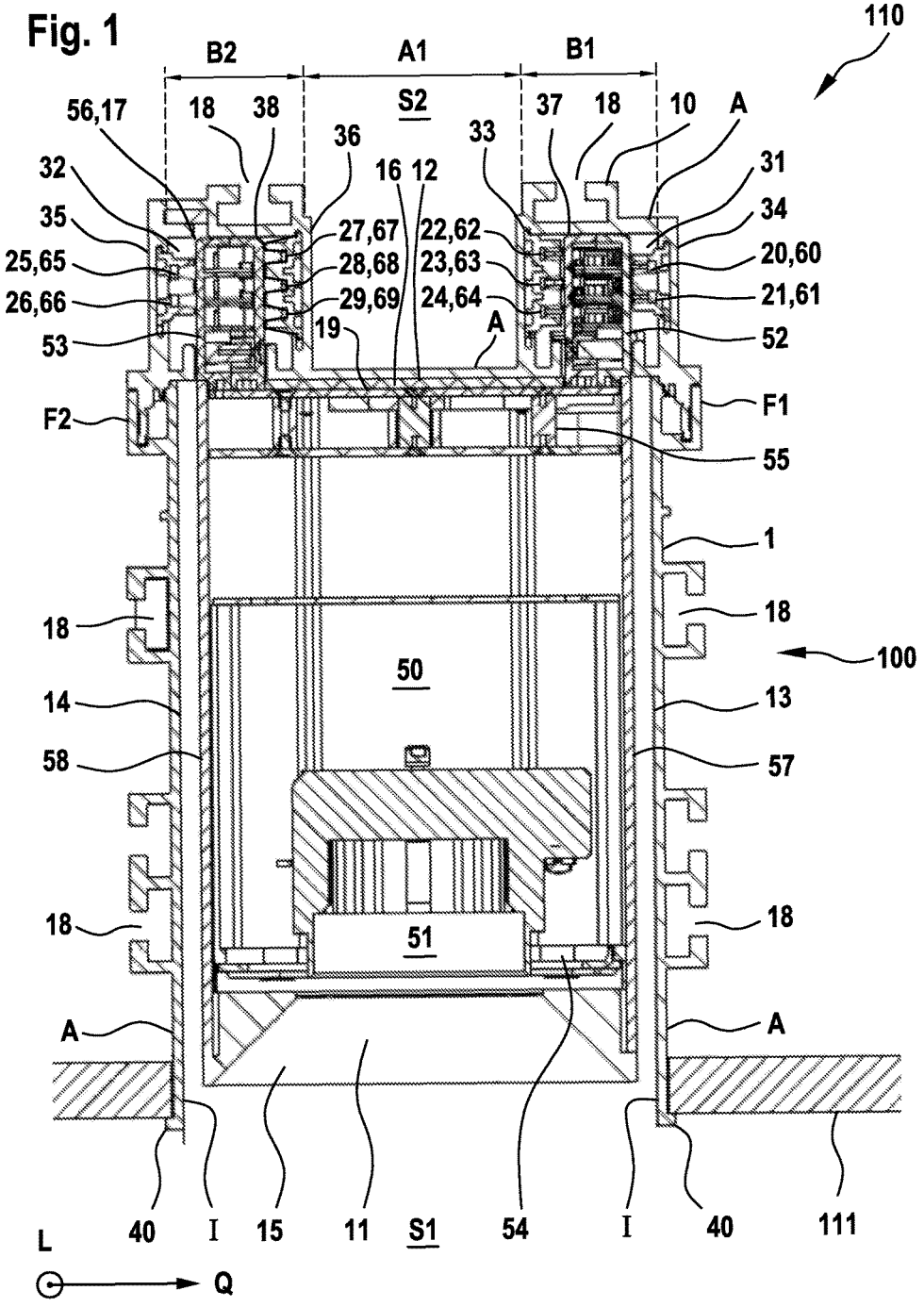
FIG. 1 shows a cross section through a building element having a busbar and a consumer unit.

FIG. 1 illustrates in cross section a building element 110 with a power transmission device 100. The power transmission device 100 has a busbar 1 and a consumer unit 50.

Figure 2:
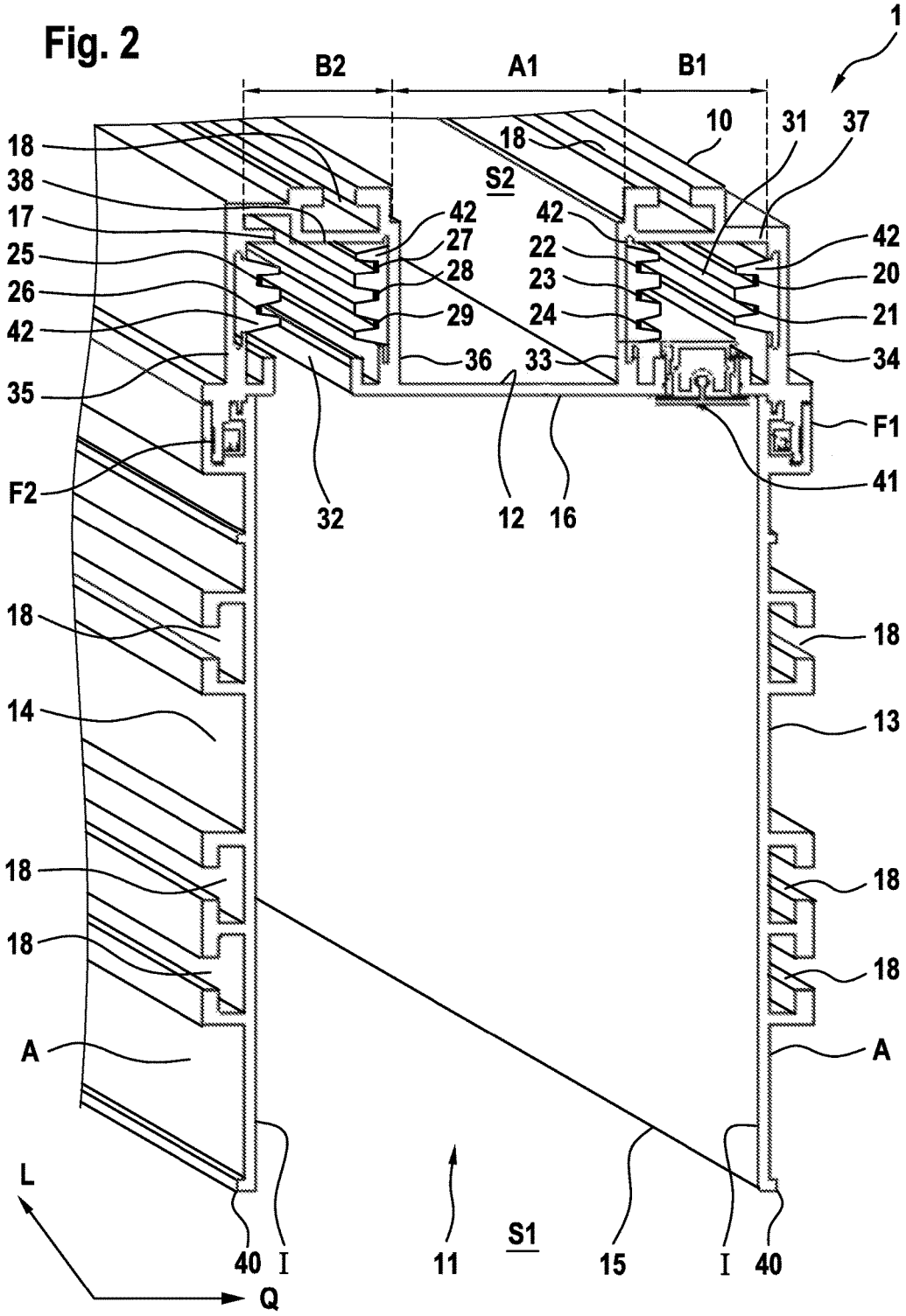
FIG. 2 shows a perspective view of a busbar.

The busbar which can be seen in FIG. 1 can also be seen in a perspective view in FIG. 2. In FIGS. 1 and 2 it is apparent that the busbar 1 has a profiled body 10 which forms an elongate receiving channel 11. The receiving channel 11 has a receiving opening 15, a first sidewall 13, a second sidewall 14 and a channel floor 12. In this way, the receiving channel 11 is bounded laterally by the first and second sidewalls 13, 14 lying opposite one another, and on the rear side S2 by the channel floor 12 of the profiled body 10, wherein the elongate receiving opening 15, which is open at the longitudinally directed L ends, remains free and is bounded in the transverse direction Q by the sidewalls 13, 14. The receiving opening 15 is clearly of planar design. The channel floor 12 of the profiled body 10 connects the first and second sidewalls 13, 14 to one another.

Inner sides I of the first and second sidewalls 13, 14 which can be seen from the direction of the receiving opening 15 are of planar design. Furthermore, the inner sides I of the first and second sidewalls 13, 14 run parallel with respect to one another. As is apparent, the first and second sidewalls 13, 14 bound the receiving opening 15 with a small, outwardly protruding collar 40. The width of the collar 40 in the transverse direction is here less than three times the wall thickness of the sidewalls 13, 14. In process engineering terms it is favorable that the wall thickness of the entire profiled body 10 is essentially homogeneous.

A first groove 31 and a second groove 32, which are aligned running parallel with respect to one another are formed in the channel floor 12. Each of the grooves 31, 32 has in each case two groove sidewalls 33, 34, 35, and 36, which are connected to one another via one groove floor 37, 38 each. The first and second grooves 31, 32 are arranged on the outside in the transverse direction Q, but still between the sidewalls 13, 14. In this context, the first groove 31 adjoins the first sidewall 13, and the second groove 32 adjoins the second sidewall 14. The distance A1 between the first and second grooves 31, 32 is greater than the groove widths B1, B2 of the first and second grooves 31, 32. In the intermediate region, the channel floor 12 forms a pedestal 16 between the first and second grooves 31, 32. As is apparent, the first and second grooves 31, 32 are not very deep compared to the overall height of the profiled body 10. In particular, the depth of the first and second grooves 31, 32 is less than 25% of the total depth of the receiving channel 11.

The profiled body 10 has, with the exception of an off-center alignment rail 17, a mirror-symmetrical cross section. The alignment rail 17 is embodied as a groove. The latter is located in the region of the groove floor 38 of the second groove 32.

The channel floor 12 is aligned perpendicularly with respect to the first and second sidewalls 13, 14 in the region between the first and second grooves 31, 32. As a result, a rectangular receiving channel 11 is produced. In this context, the openings of the first and second grooves 31, 32 are parallel with respect to the receiving opening 15 or with respect to the pedestal 16 or perpendicular with respect to the sidewalls 13, 14.

On the outside A of the first and second sidewalls 13, 14 and the channel floor 12 in each case at least two T grooves 18 are formed which are used for mounting.

Furthermore, FIGS. 1 and 2 show that the profiled body 10 is composed of a plurality of profiled parts, in particular three. Each of them is extruded profiled parts. The division is selected such that the first and second sidewalls 13, 14 and the channel floor 12 can each be differentiated, in particular are associated with one of the profiled parts. The two profiled parts of the first and second sidewalls 13, 14 are identical parts. The profiled parts of the first and second sidewalls 13, 14 are each plugged onto the profiled part of the channel floor 12 at a joint F1, F2. For this purpose, spring-elastic latching geometries are formed on the profiled parts.

The channel floor 2 forms in each case undercuts over the two grooves 31, 32. Electrical conductors 20, 21, 22, 23, 24, 25, 26, 27, 28, 29 are concealed behind them and are arranged in the two grooves 31, 32 and run in the longitudinal direction. In total, ten electrical conductors 20, 21, 22, 23, 24, 25, 26, 27, 28, 29 are mounted on the profiled body 10 in such a way that they run in the longitudinal direction L of the profiled body 10 and are insulated from one another. Because the profiled body 10 is composed here of an electrically conductive material, in each case groups of two and three of the electrical conductors 20, 21, 22, 23, 24, 25, 26, 27, 28, 29 are mounted electrically insulated from one another in a common insulating body 42 and are attached in turn to the profiled body 10. Therefore, none of the electrical conductors 20, 21, 22, 23, 24, 25, 26, 27, 28, 29 are arranged outside the first and second grooves 31, 32.

It is apparent that the electrical conductors 20, 21, 22, 23, 24, 25, 26, 27, 28, 29 are all mounted on the groove sidewalls 33, 34, 35, 36. The groove floors 37, 38 which can be seen when considered precisely remain visually free of disruptive objects. For the attachment of the electrical conductors 20, 21, 22, 23, 24, 25, 26, 27, 28, 29 to the groove sidewalls 33, 34, 35, 36, in each case T grooves are formed on the profiled body 10, for receiving the electrical conductors 20, 21, 22, 23, 24, 25, 26, 27, 28, 29 and the insulating body 42.

Owing to the undercuts which make the access to the grooves 31, 32 narrower, the electrical conductors 20, 21, 22, 23, 24, 25, 26, 27, 28, 29 are arranged so as to be covered when considered from the direction of the receiving opening 15. In particular, the electrical conductors 20, 21, 22, 23, 24, 25, 26, 27, 28, 29 do not have a point of intersection with a viewing axis which intersects the receiving opening 15 orthogonally.

The electrical conductors 20, 21, 22, 23, 24, 25, 26, 27, 28, 29 are power conductors 22, 23, 24, 25, 26, 27, 28, 29, data conductors 20, 21 and grounding conductors 26, 29. All the electrical conductors 25, 26, 27, 28, 29 with a low voltage of over 50 V AC voltage are arranged in the second groove 32. Exclusively electrical conductors 20, 21, 22, 23, 24, 25 with a maximum low voltage of 50 V AC are arranged in the first groove 31, as are also the data conductors 20, 21. The low voltage is preferably 12 V or 24 V AC and the low voltage is preferably 120 V±15 V or 230 V±23 V AC voltage.

A colored decorative rail 19 is illustrated in the region of the channel floor 12 only in FIG. 1, the decorative rail 19 being attached in an exchangeable fashion to the profiled body 10 and being visible from the direction of the receiving opening 15. The decorative rail 19 rests, in particular, on the pedestal 16.

In FIG. 2 it is additionally possible to see a covering strip 41 for the first and/or second groove 31, 32. The covering strip 41 is latched into the first groove 31 here.

Figure 3:
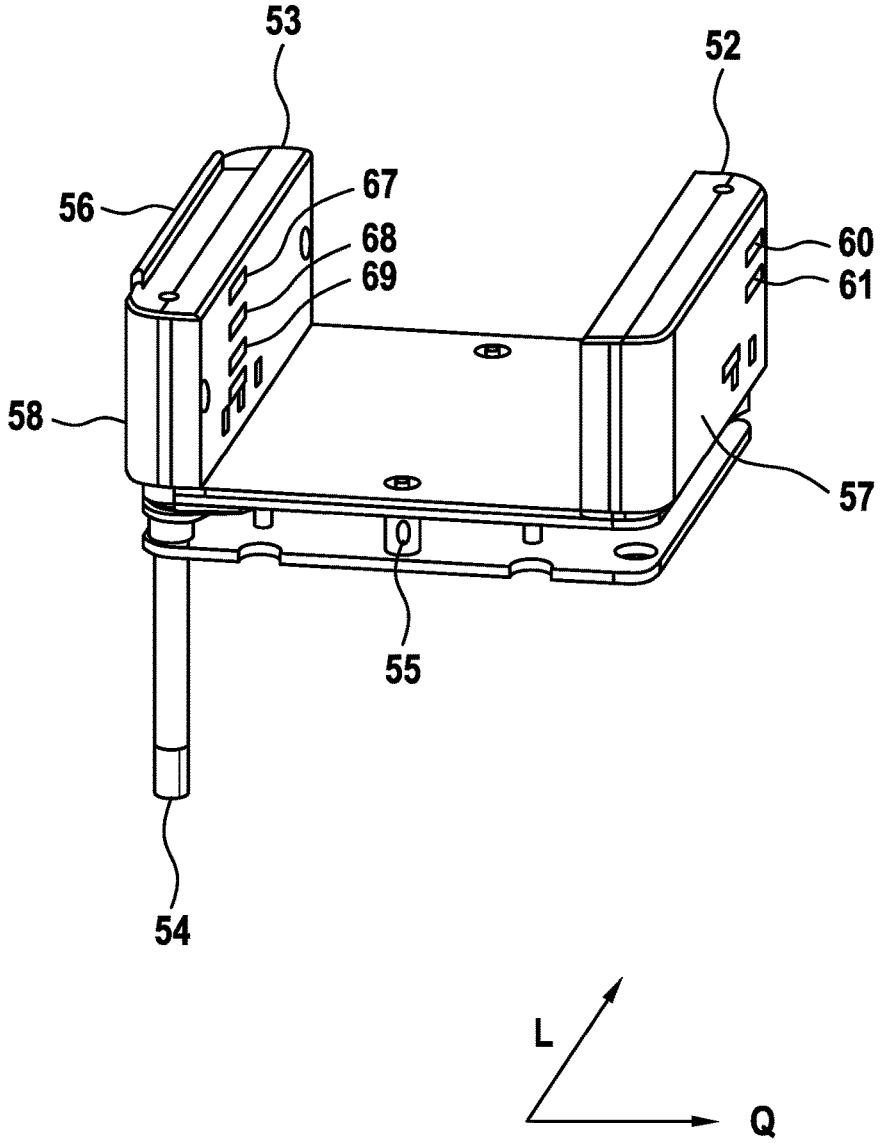
FIG. 3 shows a perspective view of a sub-region of a consumer unit.

The consumer unit 50 according to FIG. 1 which is associated with the power transmission device 100 can also be seen as a detail in FIG. 3.

According to FIG. 1, the consumer unit 50 has a functional element 51. The functional element 51 can be, for example, from the group comprising a lighting means, projector, ceiling light, light strip, spotlight, camera, loudspeaker, screen, socket, data interface, daylight sensor, image sensor, movement sensor, movement detector, smoke sensor, smoke detector, fan, air-conditioning device, HVAC diffuser or a combination thereof. A housing of the consumer unit 50 has sidewalls 57, 58 which lie opposite one another and with which the consumer unit 50 is arranged spaced apart from the inner sides I of the first and second sidewalls 13, 14 of the profiled body 10 in the transverse direction Q. It is apparent that the consumer unit 50 is arranged completely within the receiving channel 11.

FIGS. 1 and 3 each show that the consumer unit 50 has two free-standing parallel runners 52, 53. They are each arranged on the outside. According to FIG. 1, they are also arranged flush with the sidewalls 57, 58. Laterally extendible coupling elements 60, 61, 62, 63, 64, 65, 66, 67, 68, 69 are arranged in each of the two runners 52, 53. At least one of the laterally extendible coupling elements 60, 63, 64 is an electrical contact element. In particular, there are three of them here. In this context, electrical energy is made available via the coupling element 63, in particular, according to FIG. 1, via the low voltage conductor 23, and later diverted via the coupling element 64, in particular to the grounding conductor 24. The coupling element 60 is used to receive and to output data, in particular from the data conductor 20, for example for switching and dimming a lamp or for signaling a movement.

Each of the electrical contact elements 60, 63, 64 and also the further contact elements 61, 62, 65, 66, 67, 68, 69 each form a mechanical locking element by engaging in a groove in the insulating body 42, in which grooves in each case one of the electrical conductors 20, 21, 22, 23, 24, 25, 26, 27, 28, 29 runs.

The extension and retraction of the coupling elements 60, 61, 62, 63, 64, 65, 66, 67, 68, 69 is brought about by pivoting, in particular about an orthogonal with respect to the receiving opening 15. On the side of the consumer unit 50 lying opposite the runners 52, 53, in particular the front side S1, a tool receptacle 54 is formed which is connected to the laterally extendible coupling elements 60, 61, 62, 63, 64, 65, 66, 67, 68, 69 via a mechanical gear mechanism 55. Extension or retraction of the coupling elements 60, 61, 62, 63, 64, 65, 66, 67, 68, 69 can be brought about by means of an activation operation on the tool receptacle 54. An attachment tool with a manual activation means or an attachment motor with a driven tool can optionally be fitted onto the consumer unit 50. This simplifies the mounting, in particular overhead on the ceiling. Such an attachment tool or such an attachment motor should fasten the consumer unit 50 for simple handling until it is secured to the busbar 1.

The gear mechanism can accommodate parts of the mechanical gear mechanism 55, for example a gear drive and/or a belt drive, in the intermediate plane shown. In this way, the force can be distributed among all the coupling elements 60, 61, 62, 63, 64, 65, 66, 67, 68, 69.

In particular, FIG. 3 shows an alignment means 56 of the consumer unit 50. The alignment means 56 is embodied as a fin on the underside of the second runner 53. With the latter, the consumer unit 50 according to FIG. 1 engages in the alignment rail 17. With rotated orientation, the consumer unit 50 does not come to rest on the pedestal 16 and cannot be secured to the busbar because the coupling elements 60, 61, 62, 63, 64, 65, 66, 67, 68, 69 cannot extend.

According to FIG. 1, the consumer unit 50 is therefore actuated via the electrical conductor 20. For this purpose, a chip for receiving and implementing control signals and/or for outputting operating states is arranged in the consumer unit 50.

As is apparent in FIG. 1, the power transmission device 100 is installed with the busbar 10 in a planar structural element 111 from the group comprising a wall, ceiling and floor, in such a way that the receiving opening 15 is integrated flush into the planar structural element 111. Only the collar 40 is located on the planar structural element 111 in order to form a clean termination. The rest of the busbar 10 projects into the structural element 111.

The invention is not restricted to one of the embodiments described above but rather can be modified in a variety of ways.

All of the features and advantages, including structural details, spatial arrangements and method steps, which can be found in the claims, the description and the drawing may be essential to the invention either per se or else in a wide variety of combinations.

The invention claimed is:

1. A busbar having a profiled body which forms an elongate receiving channel having a channel floor, the receiving channel being bounded laterally by a first and a second sidewall of the profiled body, which sidewalls are arranged opposite one another, the first and second sidewalls bounding, on a front side of the profiled body, an elongate receiving opening of the receiving channel in the transverse direction, the channel floor of the profiled body connecting the first and second sidewalls to one another, at least two electrical conductors being mounted on the profiled body in such a way that they run in the longitudinal direction of the profiled body and are insulated from one another, wherein a first and a second groove are formed in the channel floor, wherein the electrical conductors are arranged in the first and second groove, respectively, and wherein the first and second grooves each have two groove sidewalls which are connected to one another via a groove floor, the electrical conductors are mounted on the groove sidewalls, and T grooves for receiving the electrical conductors are respectively formed on the groove sidewalls.

2. The busbar of claim 1, wherein the electrical conductors are covered when considered from the direction of the receiving opening.

3. The busbar of claim 1 wherein the channel floor forms a pedestal between the first and second groove.

4. The busbar of claim 1 wherein the profiled body has a plurality of assembled profiled parts, the first and second sidewalls being associated with different profiled parts.

5. The busbar of claim 4, wherein the profiled body is composed of three profiled parts.

6. The busbar of claim 4 wherein the channel floor is associated with another profiled part than the first and second sidewalls.

7. The busbar of claim 4 wherein the profiled parts are plugged together at joints.

8. The busbar of claim 1 wherein the profiled body has, with the exception of an off-center alignment rail, a mirror-symmetrical cross section.

9. The busbar of claim 8, wherein the alignment rail is formed in the region of the groove floor of the first or the second groove.

10. The busbar of claim 1 wherein exclusively electrical conductors with a maximum low voltage of 50 V AC are arranged in the first groove.

11. The busbar of claim 1 wherein all the electrical conductors with a low voltage of over 50 V AC are arranged in the second groove.

12. The busbar of claim 1 wherein at least one T groove is respectively formed on the outside of the first sidewall and/or of the second sidewall and/or of the channel floor by the profiled body.

13. The busbar of claim 1 wherein a colored decorative rail is attached to the profiled body in an exchangeable fashion in the region of the channel floor, which decorative rail can be viewed from the direction of the receiving opening.

14. The busbar of claim 1 wherein the inner sides of the first and second sidewalls which can be viewed from the direction of the receiving opening are of planar design.

15. The busbar of claim 1 wherein the inner sides of the first and second sidewalls are aligned in parallel with one another.

16. The busbar of claim 1 wherein the first and second sidewalls bound the receiving opening with an outwardly projecting collar.

17. The busbar of claim 1 wherein the busbar has at least one covering strip for the first and/or second groove which mates to the first and/or the second groove.

18. An apparatus comprising a busbar and a consumer unit for securing to the busbar and for drawing current or data from the busbar wherein the busbar has a profiled body which forms an elongate receiving channel having a channel floor, the receiving channel being bounded laterally by a first and a second sidewall of the profiled body, which sidewalls are arranged opposite one another, the first and second sidewalls bounding, on a front side of the profiled body, an elongate receiving opening of the receiving channel in the transverse direction, the channel floor of the profiled body connecting the first and second sidewalls to one another, at least two electrical conductors being mounted on the profiled body in such a way that they run in the longitudinal direction of the profiled body and are insulated from one another, wherein a first and a second groove are formed in the channel floor, wherein the electrical conductors are arranged in the first and second groove, respectively, and wherein the first and second grooves each have two groove sidewalls which are connected to one another via a groove floor, the electrical conductors are mounted on the groove sidewalls, and T grooves for receiving the electrical conductors are respectively formed on the groove sidewalls.

19. The apparatus of claim 18 wherein the consumer unit has a functional element.

20. The apparatus of claim 18 wherein the consumer unit has two free-standing parallel runners.

21. The apparatus of claim 20 wherein at least one laterally extendible coupling element is arranged in at least one of the runners.

22. The apparatus of claim 21 wherein at least one of the laterally extendible coupling elements is an electrical contact element.

23. The apparatus of claim 21 wherein the coupling elements are extended by pivoting.

24. The apparatus of claim 21 wherein on the side of the consumer unit lying opposite the runners, a tool receptacle is formed which is connected to the laterally extendible coupling elements via a mechanical gear mechanism, it being possible to bring about extension or retraction of the coupling elements by means of an activation operation on the tool receptacle.

25. The apparatus of claim 24 wherein the mechanical gear mechanism has a gear drive or a belt drive.

26. The apparatus of claim 18 having an alignment means.

27. The apparatus of claim 18 wherein the consumer unit is at least 75 vol % arranged within the receiving channel.

28. The apparatus of claim 18 wherein the consumer unit has sidewalls which lie opposite with respect to one another and with which the consumer unit is arranged spaced apart in the transverse direction with respect to the inner sides of the first and second sidewalls of the profiled body.

29. The apparatus of claim 18 wherein the consumer unit is actuated by means of one of the electrical conductors.

30. The apparatus of claim 18 wherein a chip for receiving and implementing control signals and/or outputting operating states is arranged in the consumer unit.

31. The apparatus of claim 30 wherein the reception and the implementation of control signals and/or the outputting of operating states are carried out via one of the electrical conductors.

32. The apparatus of claim 30 wherein the reception and the implementation of control signals and/or the outputting of operating states takes place in a wireless fashion.

33. A building element having a planar structural element composed of the group comprising the wall, ceiling and floor, wherein a busbar is integrated flush with a receiving opening into the planar structural element, wherein the busbar has a profiled body which forms an elongate receiving channel having a channel floor, the receiving channel being bounded laterally by a first and a second sidewall of the profiled body, which sidewalls are arranged opposite one another, the first and second sidewalls bounding, on a front side of the profiled body, an elongate receiving opening of the receiving channel in the transverse direction, the channel floor of the profiled body connecting the first and second sidewalls to one another, at least two electrical conductors being mounted on the profiled body in such a way that they run in the longitudinal direction of the profiled body and are insulated from one another, wherein a first and a second groove are formed in the channel floor, wherein the electrical conductors are arranged in the first and second groove, respectively, and wherein the first and second grooves each have two groove sidewalls which are connected to one another via a groove floor, the electrical conductors are mounted on the groove sidewalls, and T grooves for receiving the electrical conductors are respectively formed on the groove sidewalls.

34. A method of using a consumer unit, the method comprising securing the consumer unit to a busbar, wherein the busbar has a profiled body which forms an elongate receiving channel having a channel floor, the receiving channel being bounded laterally by a first and a second sidewall of the profiled body, which sidewalls are arranged opposite one another, the first and second sidewalls bounding, on a front side of the profiled body, an elongate receiving opening of the receiving channel in the transverse direction, the channel floor of the profiled body connecting the first and second sidewalls to one another, at least two electrical conductors being mounted on the profiled body in such a way that they run in the longitudinal direction of the profiled body and are insulated from one another, wherein a first and a second groove are formed in the channel floor, wherein the electrical conductors are arranged in the first and second groove, respectively, and wherein the first and second grooves each have two groove sidewalls which are connected to one another via a groove floor, the electrical conductors are mounted on the groove sidewalls, and T grooves for receiving the electrical conductors are respectively formed on the groove sidewalls; and drawing current or data from the busbar.

* * * * *